US005118984A

United States Patent [19]

Saito et al.

[11] Patent Number: 5,118,984

[45] Date of Patent: Jun. 2, 1992

[54] ELECTRON TUBE CATHODE

[75] Inventors: Masato Saito; Ryo Suzuki; Keiji Fukuyama; Takuya Ohira; Keiji Watanabe, all of Kamakura; Hisao Nakanishi, Nagaokakyo; Kinjiro Sano, Nagaokakyo; Toyokazu Kamata, Nagaokakyo; Takashi Shinjou, Nagaokakyo, all of Japan

[73] Assignee: Mitsubishi Denki Kabushiki Kaisha, Tokyo, Japan

[21] Appl. No.: 666,002

[22] Filed: Mar. 7, 1991

[30] Foreign Application Priority Data

Mar. 7, 1990 [JP] Japan ..... 2-56855

[51] Int. Cl.[5] ..... H01J 1/20

[52] U.S. Cl. ..... 313/346 R; 313/355; 252/521

[58] Field of Search ..... 313/346 R, 346 DC, 355; 252/521

[56] References Cited

U.S. PATENT DOCUMENTS 4,313,854 2/1982 Sunahara et al. ..... 313/346 R
4,797,593 1/1989 Saito et al. ..... 313/346 R
4,864,187 9/1989 Sano et al. ..... 313/346 R

FOREIGN PATENT DOCUMENTS 210805 2/1987 European Pat. Off. .
1120605 12/1961 Fed. Rep. of Germany .
2945995 5/1980 Fed. Rep. of Germany .
52-91358 8/1977 Japan .
2-75128 3/1990 Japan .

*Primary Examiner*—Donald J. Yusko
*Assistant Examiner*—Diab Hamadi

[57] ABSTRACT

A metal layer of not more than 2.0 μm thick is formed on a base, containing nickel as the main ingredient and a reducing agent such as silicon and magnesium, by depositing tungsten by an electron beam under heating in a vacuum. The base is heat treated in a hydrogen atmosphere at 800° to 1,100° C. An emissive material layer, containing an alkali earth metal oxide and 0.01 to 25 wt % of a rare earth metal oxide, the alkali earth metal oxide containing at least barium oxide, is formed on the metal layer. Thus, life characteristics of the cathode, especially during the operation at a high current density such as not less than $2A/cm_2$, are greatly enhanced.

20 Claims, 3 Drawing Sheets

ELECTRON TUBE CATHODE

BACKGROUND OF THE INVENTION

1. Field of the Invention

The present invention relates to the improvement of an electron tube cathode which is used for a TV cathode ray tube or the like.

2. Description of the Related Art

FIG. 3 shows an electron tube cathode which is used for a TV cathode ray tube or an image pick-up tube such as that described in, for example, Japanese Patent Publication No. 5417/1989. In FIG. 3, the reference numeral 1 represents a base composed of nickel as the main ingredient and further containing a trace amount of reducing element such as silicon (Si) and magnesium (Mg); 2 represents a cathode sleeve composed of nichrome or the like; 5 represents an emissive material layer which is formed on the upper surface of the base 1. The emissive material layer is composed of alkaline earth metal oxides as the main ingredients and 0.1 to 20 wt % of a rare earth metal oxide such as scandium oxide. Further, the alkali earth metal oxides contain at least barium oxide and further strontium and/or calcium oxide. Finally, 3 in FIG. 3 represents a heater disposed in the base 1, for heating the cathode so as to emit thermions from the emissive material layer 5.

A method of forming the emissive material layer 5 on the base 1 in an electron tube cathode having the above-described structure will now be explained. Barium carbonate, strontium carbonate, calcium carbonate and a predetermined amount of scandium oxide are first mixed together with a binder and a solvent to prepare a suspension. The suspension is sprayed onto the base 1 to a thickness of about 800 μm and thereafter heated by the heater 3 during the cathode ray tube evacuating process. At this time, the carbonates of the alkali earth metals are converted into alkali earth metal oxides. Thereafter, a part of the alkali earth metal oxides are reduced and activated so as to have semiconductivity. Thus, the emissive material layer 5 composed of a mixture of the alkali earth metal oxides and a rare earth metal oxide is formed on the base 1.

A part of the alkali earth metal oxides are reacted in the following manner in the activating process. The reducing elements such as silicon and magnesium, which are contained in the base 1, move to the interface between the alkali earth metal oxides and the base 1 by diffusion and react with the alkali earth metal oxides. For example, if the alkali earth metal oxide is assumed to be barium oxide (BaO), the reducing elements react in accordance with the following reaction formulas:

$$BaO+\tfrac{1}{2}Si=Ba+\tfrac{1}{2}Ba_2SiO_4 \quad (1)$$

$$BaO+MgO=Ba+MgO \quad (2)$$

As a result of these reactions, a part of the alkali earth metal oxides which are formed on the base 1 are reduced to be an oxygen deficient semiconductor, thereby facilitating electron emission. If the emissive material layer contains no rare earth metal oxide, the operation is possible at a temperature of 700° C. to 800° C. and a current density of 0.5 to 0.8 A/cm$^2$. If the emissive material layer contains a rare earth metal oxide, the operation is possible at a current density of 1.32 to 2.64 A/cm$^2$.

Since the electron emission capability of an oxide cathode generally depends on the excess Ba content existing in the oxide, if no rare earth metal oxide is contained, the supply of excess Ba sufficient for the operation at a high current is not procured and the current density which enables the operation is low. In this case, excess Ba is not supplied sufficiently because the by-products of the above reactions such as magnesium oxide (MgO) and barium silicate ($Ba_2SiO_2$) are concentrated on the grain boundary of the nickel of the base 1 or of the interface between the base 1 and the emissive material layer 5 to form what is called an intermediate layer. Thus, the rates of the reactions represented by the formulas (1) and (2) are controlled by the diffusion rates of the magnesium and silicon in the intermediate layer. On the other hand, if the emissive material layer contains a rare earth metal oxide, for example, scandium oxide ($Sc_2O_3$), a part of reducing agent which diffuses and moves in the base 1 during the operation of the cathode reacts with scandium oxide ($Sc_2O_3$) in accordance with the reaction formula (3) in the interface between the base 1 and the emissive material layer 5, thereby producing a small amount of scandium in the form of a metal. Further, a part of the metal scandium is dissolved in the nickel in the base 1 in the form of a solid, and a part thereof exists in the interface.

$$\tfrac{1}{2}Sc_2O_3+3/2Mg=Sc+3/2MgO \quad (3)$$

It is considered that since the metal scandium, produced by the reaction represented by the formula (3), has an action of decomposing the intermediate layer which has been formed on the base 1 or on the grain boundary of the nickel of the base 1 in accordance with the formula (4), the supply of excess Ba is improved and the operation is possible at a higher current density than in the case of containing no rare earth metal oxide.

$$\tfrac{1}{2}Ba_2SiO_4+4/3Sc=Ba+\tfrac{1}{2}Si+2/3Sc_2O_3 \quad (4)$$

Japanese Patent Laid-Open No. 91358/1977 discloses a technique of producing a direct-heated cathode by preparing a base of an Ni alloy which contains a high-melting metal such as W and Mo for increasing the mechanical strength and a reducing agent such as Al, Si and Zr and coating the surface of the base on which an emissive material layer is formed with a layer of an alloy such as Ni-W and Ni-Mo.

Japanese Patent Laid-Open No. 75128/1990 discloses a cathode composed of a nickel base metal, an oxide layer of an alkali earth metal containing barium oxide and formed on the nickel base metal, and a metal layer containing scandium and at least one element selected from the group consisting of platinum, iridium and rhodium and formed between the nickel base metal and the oxide layer.

In the electron tube cathodes having the above-described structures, although the rare earth metal oxide improves the supply of excess Ba, the excess Ba supplying rate is controlled by the diffusion rate of the reducing agent in the nickel of the base. Further, the life characteristics of the cathode are greatly deteriorated in the operation at a high current density such as that not less than 2A/cm$^2$.

The technique disclosed in Japanese Patent Laid-Open No. 91358/1977 is aimed at ameliorating the thermal deformation of the base, which is the intrinsic problem of a direct-heated cathode for emitting thermions from the emissive material layer by utilizing the heat of the base itself which is heated by the application of a current, by coating the base with a layer of an alloy such as Ni-W and Ni-Mo. This technique does not enable the operation at a high current density.

In the cathode disclosed in Japanese Patent Laid-Open No. 75128/1990, since the metal layer on the base is composed of a metal having smaller reducibility than tungsten or molybdenum, it has almost no barium oxide reducing effect for enabling the operation at a high current density.

SUMMARY OF THE INVENTION

Accordingly, it is an object of the present invention to provide an electron tube cathode with the life characteristics in the operation at a high current density enhanced by forming a metal layer, containing at least one selected from the group consisting of tungsten and molybdenum, on a base containing at least one reducing agent, and forming an emissive material layer containing an alkali earth metal oxide as the main ingredient and 0.01 to 25 wt % of a rare earth metal oxide, the alkali earth metal oxide containing at least barium oxide, on the metal layer.

In the present invention, since not only the reducing agent in the base, but also the metal layer formed on the base, contributes to the supply of excess Ba, and since the metal layer also contributes to the production of a rare earth metal which stably has an intermediate layer decomposing effect in the interface, the life characteristics of the cathode especially in the operation at a high current density, such as not less than $2A/cm^2$, are greatly enhanced.

The above and other objects, features and advantages of the present invention will become clear from the following description of a preferred embodiment thereof, taken in conjunction with the accompanying drawings.

DESCRIPTION OF THE PREFERRED EMBODIMENT

Figure 1:
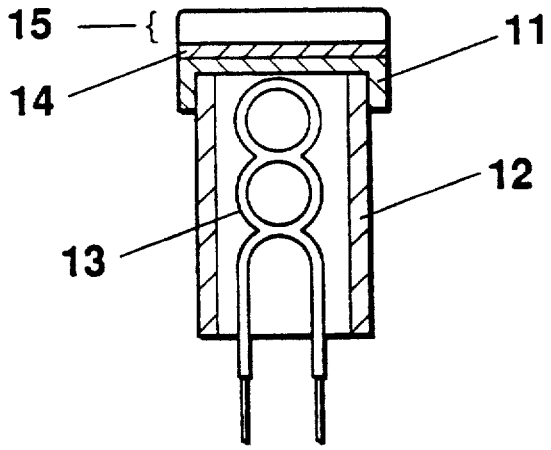
FIG. 1 shows the structure of an embodiment of an electron tube cathode according to the present invention.

An embodiment of the present invention will be explained hereinunder with reference to FIG. 1. In FIG. 1, the reference numeral 14 represents a metal layer containing at least one element selected from the group consisting of W and Mo, and formed on the upper surface of a base 11, and 15 an emissive material layer which is formed on the metal layer 14. It further and contains an alkali earth metal oxide as the main ingredient and 0.01 to 25 wt % of a rare earth metal oxide such as scandium oxide and yttrium oxide. The alkali earth metal oxide of the emissive material layer 15 contains at least barium oxide and further contains strontium oxide and/or calcium oxide.

Figure 2:
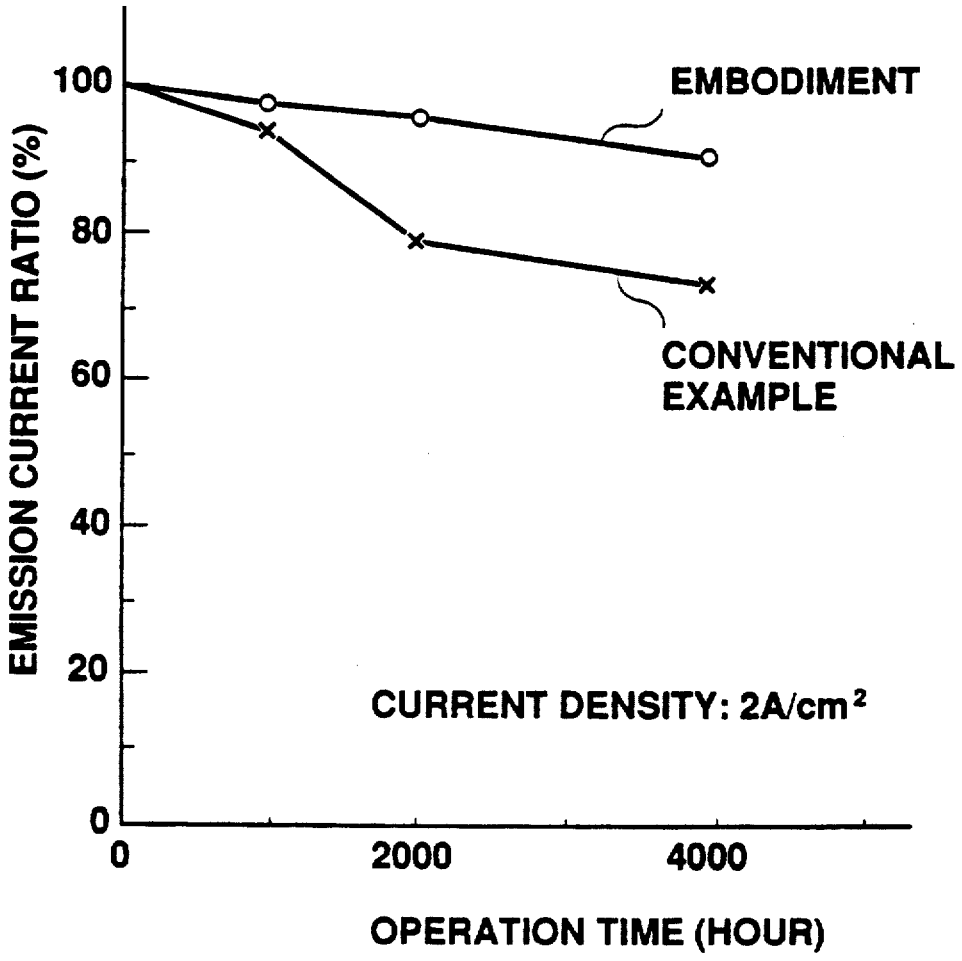
FIG. 2 is a graph showing the life characteristics of the embodiment shown in FIG. 1 at a current density of $2A/cm^2$ in comparison with those of a conventional electron tube cathode.
Figure 3:
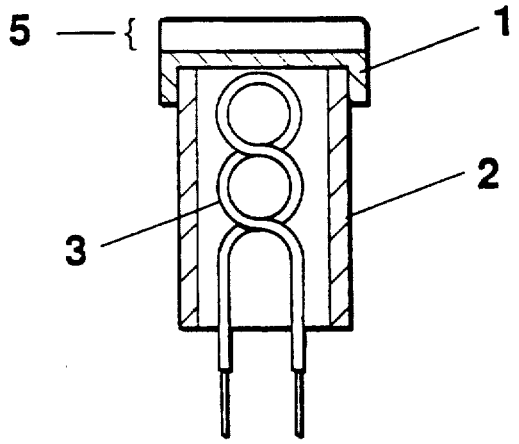
PRIOR ART Fig. 3
FIG. 3 shows the structure of an embodiment of a conventional electron tube cathode.

A method of forming the metal layer 14 on the base 11 in an electron tube cathode having the above-described structure will now be explained. The Ni base 11 containing a small amount of Si and Mg is first welded to a cathode sleeve 12, and the base portion of the cathode is disposed in, for example, an electron beam depositing device so as to deposit W by heating by the electron beam in a vacuum atmosphere of about $10^{-5}$ to $10^{-8}$ Torr. Thereafter, the base portion of the cathode is heat treated at 800° C. to 1,000° C. in, for example, a hydrogen atmosphere in order to remove the impurities such as oxygen remaining in the interior or on the surface of the metal layer 14, and to sinter or recrystallize the metal layer 14 or to diffuse the metal layer 14 in the base 11. On the cathode base with the metal layer 14 formed thereon in this way, the emissive material layer 15 is formed in the same way as in the related art. FIG. 2 is a graph showing the life characteristics of the electron tube cathode of this embodiment mounted on an ordinary cathode ray tube for a television set, which is completed through an ordinary evacuating process and operated at a current density of $2A/cm^2$, in comparison with the life characteristics of a conventional electron tube cathode. In this embodiment, a W film of 0.2 μm thick was formed as the metal layer 14 and heat treated at 1.000° C. As the emissive material 15, alkali earth metal oxides containing 3 wt % of scandium oxide were used both in this embodiment and in the conventional example. As is obvious from FIG. 2, the deterioration of emission in the life characteristics is much less than that in the conventional example.

The excellent characteristic of the electron tube cathode of this embodiment is ascribed to the following fact. Since the metal layer 14 of this embodiment is formed as a thin layer, the metal layer 14 distributes only on the Ni grains of the base 11 during operation, and since the grain boundary of Ni is exposed to the side of the emission material layer 15 on the upper surface of the base 11, the reducing agent in the base 11 is not influenced by the metal layer 14 and supplies excess Ba on the basis of the formulas (1) and (2). In addition, W of the metal layer 14 contributes to the supply of excess Ba by the reduction of the emissive material layer 15 in accordance with the following formula:

$$2BaO+\tfrac{1}{3}W=Ba+\tfrac{1}{3}Ba_3WO_6 \qquad (5)$$

Furthermore, since W is distributed on and in the Ni grains of the base 11, the reaction with the scandium oxide in the emissive material layer 15 is comparatively easily carried out in spite of the smaller reducibility of W than those of Si and Mg which are the reducing agents in the base 11. Further, it and also contributes the production of Sc having an intermediate layer decomposing effect.

As a result of examining the distribution of W on the surface of the base metal and in the direction of the depth of the base metal immediately after aging by an Auger analyzing apparatus, it was observed that W had diffused approximately uniformly in the direction of the depth of the base metal. In other words, since W diffuses approximately uniformly in the Ni grains during the heat treatment and the operation of the cathode, the effect of forming the W layer is manifested, while maintaining the reducing effects of the reducing agents Si and Mg which diffuse on the grain boundary in the Ni base.

In this embodiment, the metal layer 14 is composed of W. The metal layer 14 preferably contains at least one selected from the group consisting of W and Mo. The reason for this is as follows. Since Mo has similar properties to those of W although the reducibility is slightly smaller than W, and forms an intermetallic compound with Ni like W, Mo diffuses in the Ni grains during the heat treatment of the base or during the operation of the cathode, thereby forming a uniform Ni-Mo layer and producing a similar effect to that of W.

The composition of the metal layer 14 depends on the structure of the reducing agent in the base 11, and includes at least one is selected from the group consisting of W and Mo. It is also possible to add Ni, Pt, Ir, Rh or the like to at least one selected from the group consisting of W and Mo for the metal layer 14.

The thickness of the metal layer 14 is preferably not more than 2.0 μm. Especially, if it is not more than 0.8 μm, the life characteristics in the operation at a high current density are greatly enhanced. This is because if the metal layer 14 has a thickness of not less than 2.0 μm, the diffusion rate of the reducing element in the base 11 in the emissive material layer 15 is controlled by the metal layer 14, thereby making it impossible for the reducing element to supply sufficient Ba.

As the rare earth metal oxide, $Sc_2O_3$, $Y_2O_3$ or a mixture thereof has a marked effect. When the mixing ratio of the rare earth metal oxide to the alkali earth metal oxides was 0.01 to 9 wt %, the most marked effect was produced.

The base with the metal layer 14 formed thereon is preferably heat treated in a vacuum or in a reducing agent at a maximum temperature of 800° C. to 1,100° C. The heat treatment enables the control of the metal layer 14 so as to be distributed mainly on the Ni grains of the base 11, thereby appropriately maintaining the diffusion of the reducing element in the base 11 in the emissive material layer 15.

As the reducing agent, at least one selected from the group essentially consisting of Si, Mg, W, Zr and Al is used, and use of at least one selected from the group consisting of Si and Mg, brings about a marked effect.

The electron tube cathode of this embodiment is applicable to a cathode ray tube for a TV set or an image pick-up tube. If this electron tube cathode is applied to a cathode ray tube such as projection TV and a large-size TV set and is operated at a high current, a high-luminance cathode ray tube is realized. This embodiment is effective especially for enhancing the luminance of a cathode ray tube for a high-definition TV set. If this embodiment is applied to a cathode ray tube for a display monitor at a high current density, in other words, with a smaller current output area than in the related art, a higher-definition cathode ray tube than a conventional one is realized.

As described above, according to the present invention, since a metal layer containing at least one selected from the group consisting of tungsten and molybdenum is formed on a base containing at least one reducing agent, and an emissive material layer containing an alkali earth metal oxide as the main ingredient and 0.01 to 25 wt % of a rare earth metal oxide is formed on the metal layer, the alkali earth metal oxide containing at least barium oxide, the operation at a high current density such as not less than $2A/cm^2$, which is difficult in a conventional oxide cathode, is enabled. Thus, a high-luminance and high-definition cathode ray tube, which is difficult in the related art, is realized.

What is claimed is:

1. An indirectly heated electron tube cathode comprising:

a base including nickel as a main ingredient and further including a reducing agent;

a metal layer containing either tungsten or molybdenum as a main ingredient, formed on said base; and an emissive material layer, including an alkali earth metal oxide as a main ingredient and 0.01 to 25 wt % of a rare earth metal oxide, formed on said metal layer, said alkali earth metal oxide including at least barium oxide.

2. An indirectly heated electron tube cathode according to claim 1, wherein said reducing agent contained in said base includes at least one of silicon and magnesium.

3. An indirectly heated electron tube cathode according to claim 1, wherein said metal layer has a thickness of, at most, 2.0 μm.

4. An indirectly heated electron tube cathode according to claim 2, wherein said metal layer has a thickness of, at most, 2.0 μm.

5. An indirectly heated electron tube cathode according to claim 2, wherein said metal layer has a thickness of, at most, 0.8 μm.

6. An indirectly heated electron tube cathode according to claim 1, wherein the base, with said metal layer formed thereon, is heat treated in one of a vacuum and a reducing atmosphere at 800° C. to 1,100° C.

7. An indirectly heated electron tube cathode according to claim 2, wherein the base, with said metal layer formed thereon, is heat treated in one of a vacuum and a reducing atmosphere at 800° C. to 1,100° C.

8. An indirectly heated electron tube cathode according to claim 3, wherein the base, with said metal layer formed thereon, is heat treated in one of a vacuum and a reducing atmosphere at 800° C. to 1,100° C.

9. An indirectly heated electron tube cathode according to claim 5 wherein the base, with said metal layer formed thereon, is heat treated in one of a vacuum and a reducing atmosphere at 800° C. to 1,100° C.

10. An indirectly heated electron tube cathode comprising:

a base including nickel as a main ingredient and further including a reducing agent;

a metal layer containing either tungsten or molybdenum as a main ingredient, formed on said base; and an emissive material layer, including an alkali earth metal oxide as a main ingredient and including 0.01 to 9 wt % of at least one of scandium oxide and yttrium oxide, formed on said metal layer, said alkali earth metal oxide including at least barium oxide.

11. An indirectly heated electron tube cathode according to claim 10, wherein said reducing agent contained in said base includes at least one of silicon and magnesium.

12. An indirectly heated electron tube cathode according to claim 10, wherein said metal layer has a thickness of, at most, 2.0 μm.

13. An indirectly heated electron tube cathode according to claim 11, wherein said metal layer has a thickness of, at most, 2.0 μm.

14. An indirectly heated electron tube cathode according to claim 11, wherein said metal layer has a thickness of, at most, 0.8 μm.

15. An indirectly heated electron tube cathode according to claim 10, wherein the base, with said metal layer formed thereon, is heat treated in one of a vacuum and a reducing atmosphere at 800° C. to 1,100° C.

16. An indirectly heated electron tube cathode according to claim 11, wherein the base, with said metal layer formed thereon, is heat treated in one of a vacuum and a reducing atmosphere at 800° C. to 1,100° C.

17. An indirectly heated electron tube cathode according to claim 12, wherein the base, with said metal layer formed thereon, is heat treated in one of a vacuum and a reducing atmosphere at 800° C. to 1,100° C.

18. An indirectly heated electron tube cathode according to claim 14 wherein the base, with said metal layer formed thereon, is heat treated in one of a vacuum and a reducing atmosphere at 800° C. to 1,100° C.

19. An indirectly heated electron tube cathode comprising:

a base including nickel as a main ingredient and further including a reducing agent containing at least one of silicon and magnesium;

a metal layer, of at most 2.0 μm in thickness, including tungsten as a main ingredient, and formed on said base, subjected to heat treatment in a hydrogen atmosphere at 800° C. to 1,100° C.; and an emissive material layer including an alkali earth metal oxide and 0.01 to 25 wt % of a rare earth metal oxide, said alkali earth metal oxide including at least barium oxide, and being formed on said metal layer.

20. An indirectly heated electron tube cathode, comprising:

a base containing nickel as a main ingredient and further containing a reducing agent;

a metal layer, containing either tungsten or molybdenum, formed on said base; and an emissive material layer, containing an alkali earth metal oxide as a main ingredient and 0.01 to 9 wt % of scandium oxide, formed on said metal layer, said alkali earth metal oxide containing at least barium oxide.

* * * * *